US008047041B2

(12) United States Patent
Hermann et al.

(10) Patent No.: US 8,047,041 B2
(45) Date of Patent: Nov. 1, 2011

(54) METHOD OF REDUCING THICKNESS OF UNBROKEN ROLLING STOCK

(75) Inventors: Fritz Hermann, Landsberg (DE); Christoph Wiedner, Sulz (AT); Frank Bertram, Rickenbach (DE); Frank Jackel, Aachen (DE)

(73) Assignee: Hilti Aktiengesellschaft, Schann (LI)

( * ) Notice: Subject to any disclaimer, the term of this patent is extended or adjusted under 35 U.S.C. 154(b) by 747 days.

(21) Appl. No.: 12/228,792

(22) Filed: Aug. 15, 2008

(65) Prior Publication Data

US 2009/0095045 A1 Apr. 16, 2009

(30) Foreign Application Priority Data

Aug. 16, 2007 (DE) ..... 10 2007 038 554
Nov. 28, 2007 (EP) ..... 07121819

(51) Int. Cl.
*B21B 39/00* (2006.01)
*B21D 11/08* (2006.01)

(52) U.S. Cl. ..... 72/226; 72/167; 72/366.2

(58) Field of Classification Search ..... 72/167, 72/168, 176, 177, 180, 197, 199, 252.5, 365.2, 72/366.2, 377

See application file for complete search history.

(56) References Cited

U.S. PATENT DOCUMENTS 4,357,818 A * 11/1982 Lyon et al. ..... 72/177

* cited by examiner

*Primary Examiner* — Debra Sullivan
(74) *Attorney, Agent, or Firm* — Abelman, Frayne & Schwab

(57) ABSTRACT

A method of reducing thickness of unbroken rolling stock (14) by longitudinal rolling includes deforming the rolling stock (14) in the width direction with deformation regions (26 to 29; 86 to 88) of the rolls (22 to 25; 82 to 84) penetrating in the rolling stock to the same depth.

11 Claims, 2 Drawing Sheets

METHOD OF REDUCING THICKNESS OF UNBROKEN ROLLING STOCK

BACKGROUND OF THE INVENTION

1. Field of the Invention

The present invention relates to a method of reducing thickness of an unbroken rolling stock by longitudinal rolling according to which the rolling stock is deformed in the width direction by sidewise offset deformation regions of following one another, in the rolling stock displacement direction, rolls.

2. Description of the Prior Art

Different shapes of profiles, which are formed of a rolling stock, are well known. With material-intensive profiles such as, e.g., C-shape mounting rails, the portion of material costs in comparison with total manufacturing costs amounts to over 70%. Thus, saving of the material leads to a substantial reduction of the total manufacturing costs.

For statical reasons, a profile need not necessarily have a constant thickness or material thickness over its circumference. So, in less loaded sections, the profile thickness can be partially reduced and, thus, a certain amount of material can be saved.

A partial thickness reduction by single-stage rolling of a strip-shaped rolling stock in a cold rolling process does not make sense because due to the friction transverse to the roll and the stiffness of the flat rolling stock, the material reduction would take place only in one stretch in the longitudinal direction or in the displacement direction and would lead to hardening of material. This leads to inner stresses and a strong warping of the rolling stock.

German Publication DE 198 31 882 A1 discloses a method of producing a profile having a desired thickness from an unbroken rolling stock and according to which in order to form a thickness-reduced region, the rolling stock is deformed in the width direction by deformation regions of rolls which penetrate into a starting material over the rolling stock width to different depths.

The drawback of the method of the above-mentioned German Publication consists in that the adjustment or control of penetration of the roll deformation regions to different depths is expensive. Moreover, unevenesses, which are often undesirable, occur in the thickness-reduced sections, and in transition regions between the thickness-reduced sections and sections the thickness of which is not reduced, transverse to the rolling stock displacement direction. In addition, in order to produce sections with a constantly reduced thickness, a number of deformation steps, which are called passes, are necessary.

Accordingly, an object of the present invention is a method of reducing thickness of unbroken rolling stock and which is easily adjustable or controlled.

Another object of the present invention is a method of reducing thickness of an unbroken rolling stock and which has a smaller number of passes than the known method for producing a constant impression in the rolling stock.

SUMMARY OF THE INVENTION

These and other objects of the present invention, which will become apparent, hereinafter, are achieved by providing a method of reducing thickness of unbroken rolling stock and which includes deforming the rolling stock in the width direction with deformation regions of the rolls penetrating in the rolling stock to a same depth.

With the inventive method, there are formed, in the width direction i.e., transverse to the displacement direction or the rolling direction, between the thickness-reduced and thickness-nonreduced sections of the rolling stock, only homogenous sloping transitional regions having, at the same time, a small expansion in a direction transverse to the displacement direction. Further, the thickness-reduced section of the rolling stock, which is produced by the inventive method, has an advantageous surface quality. The roll deformation regions, which are offset in the transverse direction and penetrate into the rolling stock, insure that the deformation of the rolling stock is effected only in the width direction also at a cold rolling process.

Advantageously, a deformation region of a roll widens the rolling stock toward a respective side edge. Advantageously, at least in some of the rolls, the inwardly located, with respect to the side edges of the rolling stock, edges of the sections of the located one after another or following one another rolls, which carry the deformation regions, lie on the same line, and the width of the deformation regions increases, with respect to the inwardly located edges, in a direction transverse to the displacement direction or transverse to the rolling direction, from roll to roll.

Advantageously, each of the plurality of rolls is provided with two opposite deformation regions with one of the two regions widening the rolling stock to one side edge and with another of two regions widening the rolling stock to an opposite side edge. Thereby, the same pass, there are formed two, extending substantially parallel to each other, thickness-reduced sections in the rolling stock.

According to another advantageous embodiment of the present invention, a deformation region of a roll widens the rolling stock to both of its side edges, whereby the deformation in the width direction to both side edges is effected simultaneously by one deformation region of a roll.

Advantageously, widening of the rolling stock with deformation regions is carried out in a plane extending parallel to the roll axis. This insures an easy deformation of the rolling stock in the width direction. As a counter-support, a table, which is located in a plane extending parallel to the roll axis, or a counter-roll, the axis of which and the outer surface extend parallel to the roll axis, can be provided.

According to a further advantageous embodiment of the inventive method, oppositely located rolls are provided with deformation regions, and between which the rolling stock thickness is reduced in some regions from opposite sides in one pass.

Advantageously, the thickness-reduced rolling stock is deformed into a longitudinal profile in a further step by longitudinal rolling. To this end, at least one thickness-reduced section is so advantageously aligned that the finished profile lies in a statically advantageous region. The rolling stock, the thickness of which has been reduced at least in some regions, is advantageously fed directly to a profile rolling unit. Therefore, a reel for a thickness-reduced rolling stock for storing it before the deformation of the rolling stock into a longitudinal profile can be eliminated.

Advantageously, the thickness-reduced rolling stock is deformed in a longitudinal profile having a C-shaped cross-section, in which at least one thickness-reduced section is advantageously located in one of the side walls the bent free ends of which form a mounting opening extending in the longitudinal direction. Advantageously, the thickness-reduced rolling stock has two thickness-reduced sections advantageously located, respectively, in oppositely located side walls of a C-shaped longitudinal profile.

According to an alternative embodiment, the thickness-reduced rolling stock is deformed in a longitudinal profile having a U-shaped cross-section, with at least one of thickness-reduced sections is advantageously located in one of the side walls.

Advantageously, the thickness-reduced rolling stock is provided with openings which serve for passing therethrough of fastening means for the finished profile and which reduce weight of the finished profile. The openings are advantageously formed after profiling the thickness of the rolling stock and before deformation of the rolling stock into a finished profile.

Advantageously, the openings are formed in the thickness-reduced section of the rolling stock.

Advantageously, the thickness-reduced rolling stock is provided with stamp-out sections which stiffen the finished profile and, when correspondingly formed and arranged, noticeably increase the bearing capacity of the finished profile. The stamp-out sections advantageously are formed in the rolling stock after the profiling of the thickness of the rolling stock and before the deformation of the rolling stock into a profile.

Advantageously, the stamp-out sections are formed in the thickness-reduced section, which advantageously insure the bearing capacity of the finished profile despite of the reduced thickness of the section.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
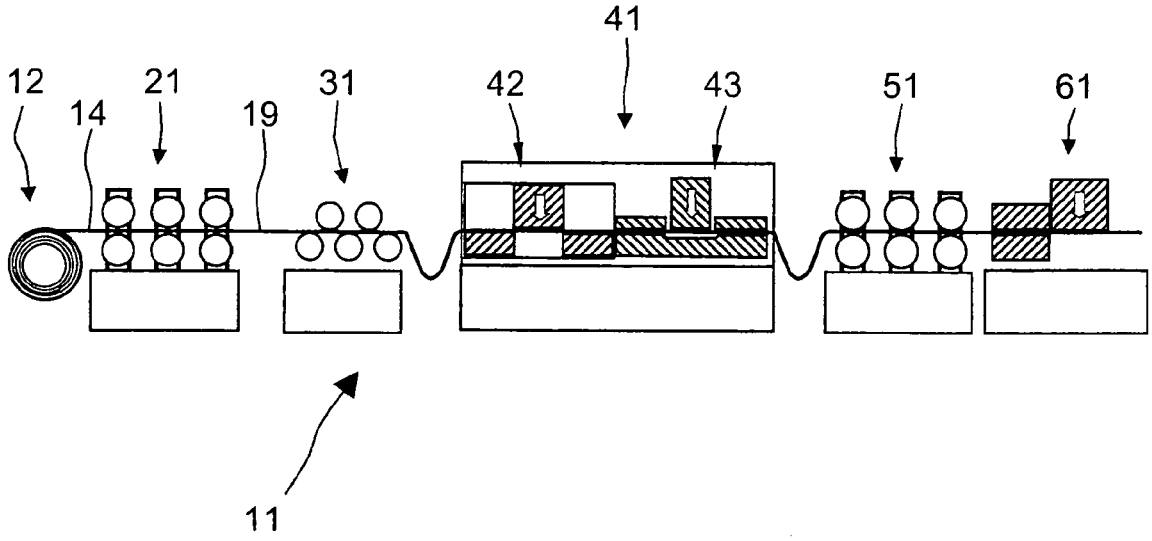
FIG. 1 a schematic side view of a rolling installation for carrying out a method according to the present invention.

A rolling installation 11 for carrying out the inventive method, which is shown in FIG. 1, includes a feeding unit 12 in form of a reel with an unbroken rolling stock 14 such as strip material, a width profile rolling unit 21, a straightening unit 31, a profile-treating unit 41, a profile rolling unit 51, and a cutting unit 61.

Figure 2:
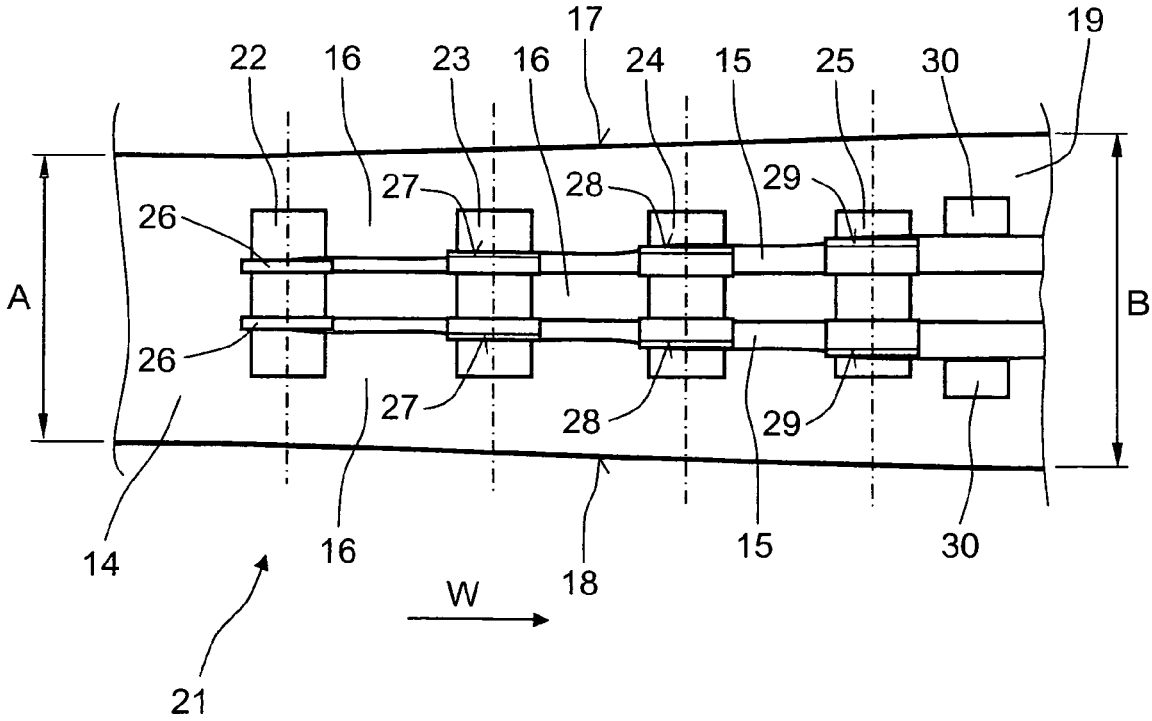
FIG. 2 a plan view of a width profile rolling unit of a rolling installation shown in FIG. 1.

The width profile rolling unit 21 which is shown schematically in FIG. 2, has, for a regional reduction of thickness of the unbroken rolling stock 14 by longitudinal rolling in a cold rolling process, a plurality of following one another, in a rolling stock displacement direction W, rolls 22 to 25. The rolls 22 to 25 have each two, sidewise displaced, deformation regions 26 to 29, respectively. The deformation regions 26 to 29 of the respective rolls 22 to 25 penetrate to the same depth into the rolling stock 14 for deforming the rolling stock 14 in the width direction. The deformation regions 26 to 29 of the rolls 22 to 25 widen the rolling stock 14 in a plane parallel to the roll axis of the rolls 22 to 25. Both deformation regions 26 to 29 of the respective rolls 22 to 25 widen the rolling stock 14 to opposite side edges 17 and 18, respectively.

In this embodiment of the width profile rolling device 21, in all of the rolls 22 to 29, the inwardly located, with respect to the side edges 17 and 18, edges of the sections of the rolls 22 to 25, which define the deformation regions 26 to 29, lie on the same line, with the width of the deformation regions 26 to 29 increasing, with respect to the inwardly located edges, in a direction transverse to the displacement direction W, from the roll 22 to the roll 24 to the roll 23 to the roll 25.

With the width profile rolling device 21, there are formed, in the rolling stock 14, two, spaced from each other and spaced from side edges 17 and 18 of the rolling stock 14, sections 15 having a reduced thickness. The width profile rolling unit 21 further includes a cylindrical plane roll 30 for rolling off of any possibly formed bulge in the transitional region between the thickness-reduced sections 15 and the sections 16 with a non-reduced thickness of the rolling stock 14.

The profile-treating unit 41 has an opening-forming device 42 for forming openings 76 in the rolling stock 19 in which thickness is reduced in some regions, and an embossing device 43 for forming stamp-out sections 77 in the rolling stock 19.

The profile rolling unit 51 has a plurality of profiling rollers which deform the substantially flat, thickness-reduced rolling stock 19 into a longitudinal profile in a further process step by longitudinal rolling. The rolling stock 19 with the regionwise reduced thickness is advantageously so fed to the profile rolling device 51 that the thickness-reduced sections 15 are located in the regions of the finished profile which is subjected to statically reduced loads. Advantageously, the thickness-reduced rolling stock 19 is deformed in a longitudinal profile 71 having a C-shaped cross-section.

Below, the inventive method will be briefly described. The rolling stock 14 with an initial width A is introduced into the width profile rolling unit 21 which increases the rolling stock width A to width B. Before the rolling stock 19 with two, thickness-reduced sections 15 is fed into the profile-treating unit 41, the thickness-reduced rolling stock 19 is straightened in the straightening unit 31 in order to eliminate possible undesirable deformations or warpings. In the profile-treating unit 41, the rolling stock 19, with a reduced thickness in some regions, is provided with the openings 76 and the stamp-out sections 77 which are formed in the thickness-reduced sections 15. Finally, the thickness-reduced and treated rolling stock 19 is deformed into a longitudinal profile in the profile rolling unit 51 in a further process step, and finally is cut to a desired length in a cutting unit 61.

Figure 4:
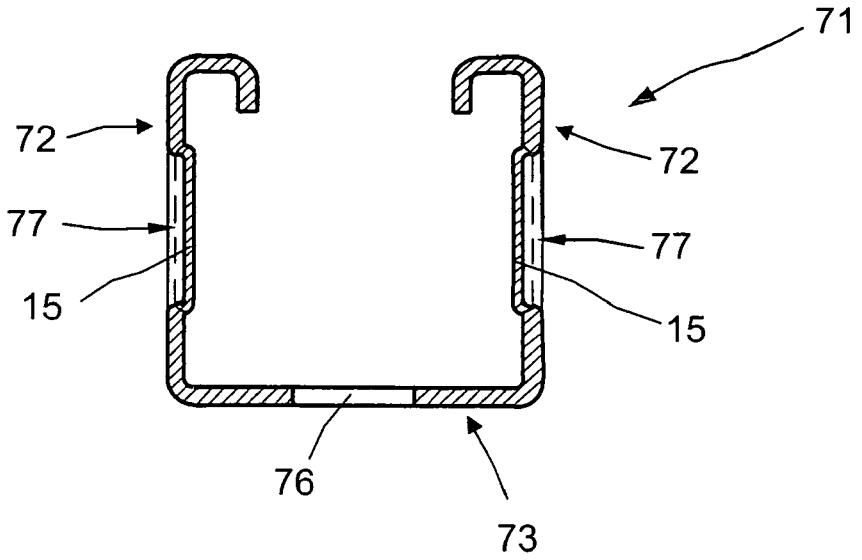
FIG. 4 a cross-sectional view of a finished profile produced with the method according to the present invention Basically, in the drawings, the same parts are designated with the same reference numerals.

FIG. 4 shows an example of a longitudinal profile formed by the inventive method in form of a profile 71 having a C-shaped cross-section, with the thickness-reduced sections 15 being provided in side walls 72. The thickness-reduced sections 15 are provided with the stamp-out sections 77 for increasing their stiffness. In the connection section 73 between the side walls 72, there is formed an opening 76, e.g., for passing of a fastening element, not shown, for securing the longitudinal profile 71, e.g., to a constructional component.

Figure 3:
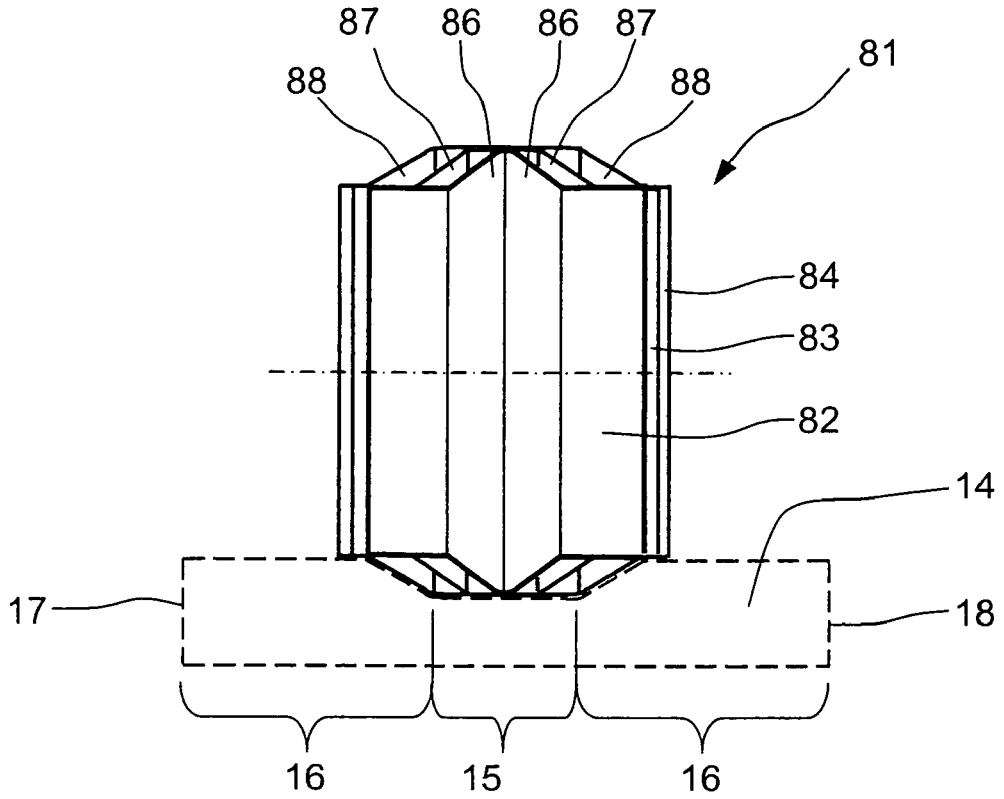
FIG. 3 a view, in a rolling direction, of another embodiment of a width profile rolling unit of the rolling installation shown in FIG. 1.

FIG. 3 shows another embodiment of the width profile rolling unit designated with a reference numeral 81 and having a plurality of following one another rolls 82 to 84 with respective sidewise offset, deformation regions 86 to 88. The deformation regions 86 to 88 of the rolls 82 to 84 penetrate equally deep in the rolling stock 14 for deforming the rolling stock 14 in the width direction, with the rolling stock 14 being widened by each respective deformation region 86, 87, and 88 to both side edges 17 and 18.

Though the present invention was shown and described with references to the preferred embodiment, such is merely illustrative of the present invention and is not to be construed as a limitation thereof and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A method of reducing thickness of unbroken rolling stock (14) by longitudinal rolling, comprising the steps of providing a plurality of rolls (22 to 25; 82 to 84) having sidewise offset deformation regions (26 to 28; 86 to 88) and arranging the plurality of rolls (22 to 25; 82 to 84) one after another in a rolling stock displacement direction (W); and deforming the rolling stock (14) in a width direction thereof with the sidewise offset deformation regions (26 to 29; 86 to 88) of the plurality of following one another, in the rolling stock displacement direction (W), rolls (22 to 25; 82 to 84), with the sidewise offset deformation regions of the rolls (22 to 25; 82 to 84) penetrating in the rolling stock to a same depth, whereby thickness of the rolling stock (14) is reduced.

2. A method according to claim 1, wherein a deformation region (26 to 29) of a roll (22 to 25) widens the rolling stock (14) toward a respective side edge (17, 18).

3. A method according to claim 1, wherein the step of providing the plurality of rolls (22 to 25; 82 to 84) includes providing rolls (22 to 25) having two opposite sidewise offset deformation regions (26 to 29), and the deforming step includes deforming the rolling stock (14) with the two opposite sidewise offset deformation regions (26 to 29), with one of the two opposite deformation regions widening the rolling stock (14) to one side edge (17) and with another of two regions widening the rolling stock to an opposite side edge (18).

4. A method according to claim 1, wherein the proving step includes providing rolls (86 to 88) having a single deformation region (86 to 88); and the deforming step includes deforming the rolling stock (14) to both side edges (17, 18) thereof with the single deformation regions (86 to 88) of the plurality of rolls (82 to 84).

5. A method according to claim 1, wherein the rolling step includes widening the rolling stock (14) with the deformation regions (26 to 29; 86 to 88) in a plane extending parallel to roll axes of the rolls (22 to 25; 82 to 84).

6. A method according to claim 1, further comprising the step of deforming a rolling stock (19), a thickness of which has already been regionally reduced, into a longitudinal profile (71) by longitudinal rolling.

7. A method according to claim 6, comprising the step of deforming the thickness-reduced rolling stock (19) into the longitudinal profile (71) having a C-shaped cross-section.

8. A method according to claim 1, comprising the step of forming openings (76) in the rolling stock (14).

9. A method according to claim 8, wherein the openings (76) are formed in a thickness-reduced section (15) of the thickness-reduced rolling stock (19).

10. A method according to claim 1, comprising the step of forming stamp-out sections (77) in the thickness-reduced rolling stock (19).

11. A method according to claim 10, wherein the stamp-out sections (77) are formed in a thickness-reduced section (15) of the thickness-reduced rolling stock (19).

* * * * *